United States Patent [19]

Favre

[11] 4,136,202

[45] Jan. 23, 1979

[54] CAPSULE FOR BEVERAGE PREPARATION

[75] Inventor: Eric Favre, Le Mont-Pélerin, Switzerland

[73] Assignee: Societe d'Assistance Technique pour Produits Nestle S.A., La Tour de Peilz, Switzerland

[21] Appl. No.: 858,347

[22] Filed: Dec. 7, 1977

[30] Foreign Application Priority Data

Dec. 17, 1976 [CH] Switzerland ..... 15913/76

[51] Int. Cl.[2] ..... B65B 29/02

[52] U.S. Cl. ..... 426/77; 99/295; 206/0.5; 426/115

[58] Field of Search ..... 426/77, 78, 79, 112, 426/115; 206/0.5; 99/295, 305

[56] References Cited

U.S. PATENT DOCUMENTS

| | | | |
|---|---|---|---|
| 1,377,316 | 5/1921 | Clermont | 99/295 |
| 2,778,739 | 1/1957 | Rodth | 426/77 |
| 2,905,075 | 9/1959 | Uebelt | 99/295 |
| 2,968,560 | 1/1961 | Goros | 99/295 |
| 3,193,388 | 7/1965 | Conrey | 206/0.5 X |
| 3,292,527 | 12/1966 | Stasse | 99/295 |
| 3,295,998 | 1/1967 | Goros | 99/295 |
| 3,357,340 | 12/1967 | Berns | 99/295 |
| 3,391,632 | 7/1968 | Colonna | 99/295 |
| 3,812,273 | 5/1974 | Schmidt | 99/295 X |

FOREIGN PATENT DOCUMENTS

| | | | |
|---|---|---|---|
| 810371 | 3/1959 | United Kingdom | 99/295 |

*Primary Examiner*—Steven L. Weinstein
*Attorney, Agent, or Firm*—Watson, Leavenworth, Kelton & Taggart

[57] ABSTRACT

A capsule containing a substance for making up a drink using an apparatus, said capsule being composed essentially of a sealed body having the general shape of an acute truncated cone with a rim at its base and of a membrane closing the base, said membrane being provided with a line of weakness delimiting an aperture.

2 Claims, 2 Drawing Figures

CAPSULE FOR BEVERAGE PREPARATION

The present invention relates to a capsule containing a substance for making up a drink using an apparatus.

Capsules of this type do exist and they are of a general cylindrical and flat shape, are composed of air-tight material to protect their content from external influences and are intended to be perforated on their two opposing faces when in use. They have the disadvantage of a low resistance to crushing when being perforated.

It has also been suggested that only one wall be pierced, that the liquid intended for making up the drink be injected into the capsule from one side and that the opposite wall be torn by the pressure of the injected liquid. This mode of operation affords the advantage of better mixing with the content of the capsule and, if necessary, of making the liquid penetrate the granules contained in the capsule, for example, in the case of ground coffee. However, the liquid flows out through the tear at random. In fact, as the liquids are practically incompressible, the slightest crack is sufficient to cause a drop in the internal pressure so that the orifice no longer increases in size and is irregular in shape.

The capsule according to the invention obviates these disadvantages. The present invention provides a capsule containing a substance for making up a drink using an apparatus, the capsule being composed essentially of a sealed body having the general shape of an acute truncated cone with a rim at its base and of a membrane closing the base and delimiting a cover, the membrane being provided with a line of weakness.

The features and advantages of the invention will be shown in the description below with reference to the acompanying drawings, given as non-limiting examples.

Figure 1:
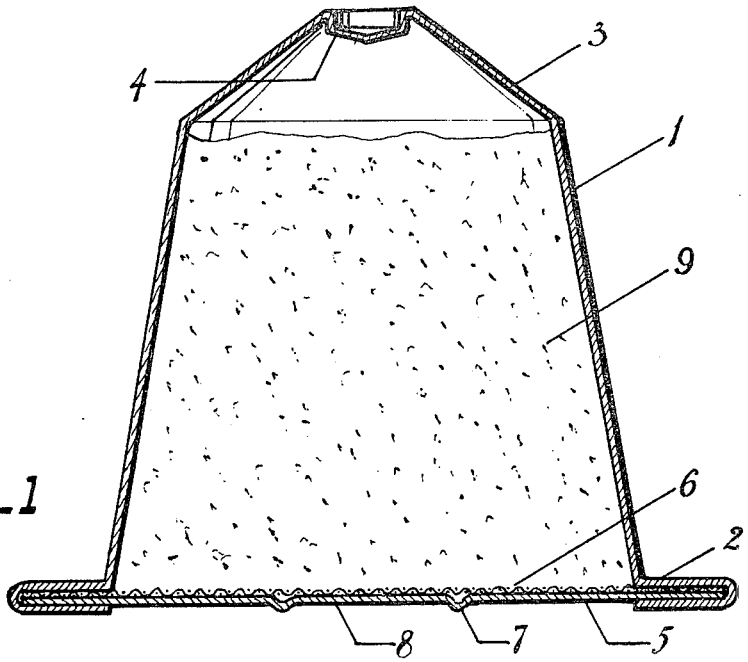
FIG. 1 is an axial section through an embodiment of a capsule according to the invention.

In the drawing, the capsule comprises a body 1 composed of sheet aluminium between 60 and 110μ thick, preferably 80μ , having the general shape of an acute truncated cone with a rim 2 at its base. The conical shape in relation to the axis is from 2 to 20°, preferably about 10° (that is to say a 20° angle at the vertex). Better resistance to crushing is thus obtained and it is easier to remove the capsule from its housing after use.

The body 1 terminates at its smallest end with an obtuse cone 3. As a variation, this end is dome-shaped. It has a substantially cylindrical recess 4. In a preferred embodiment, the bottom of this recess is weakened.

The rim 2 is formed by pinching the body around a membrane 5 closing the base and, in the example shown, a filter 6 adjacent to the membrane 5. In a preferred embodiment, the body and the membrane are thermosealed.

The membrane is composed of aluminium, preferably between 30 and 60μ thick. As a variation, it has radial grooves making it more readily deformable. It comprises a line of weakness 7 consisting of a stamped out groove of general circular shape. In a preferred embodiment, this line is not closed but is C-shaped or horseshoe-shaped.

The capsule is filled with a substance 9 for making a drink which is ground coffee in the example shown but could be tea, instant coffee, a mixture of ground coffee and instant coffee, a chocolate product, etc.

The filter 6 is composed of metal or plastic. In the case of ground coffee, good results have been obtained using a sieve composed of polypropylene with orifices of between 40 and 60μ, between 2 and 8% of the total surface being a passage surface. This filter is not essential if the capsule contains a completely soluble substance.

Figure 2:
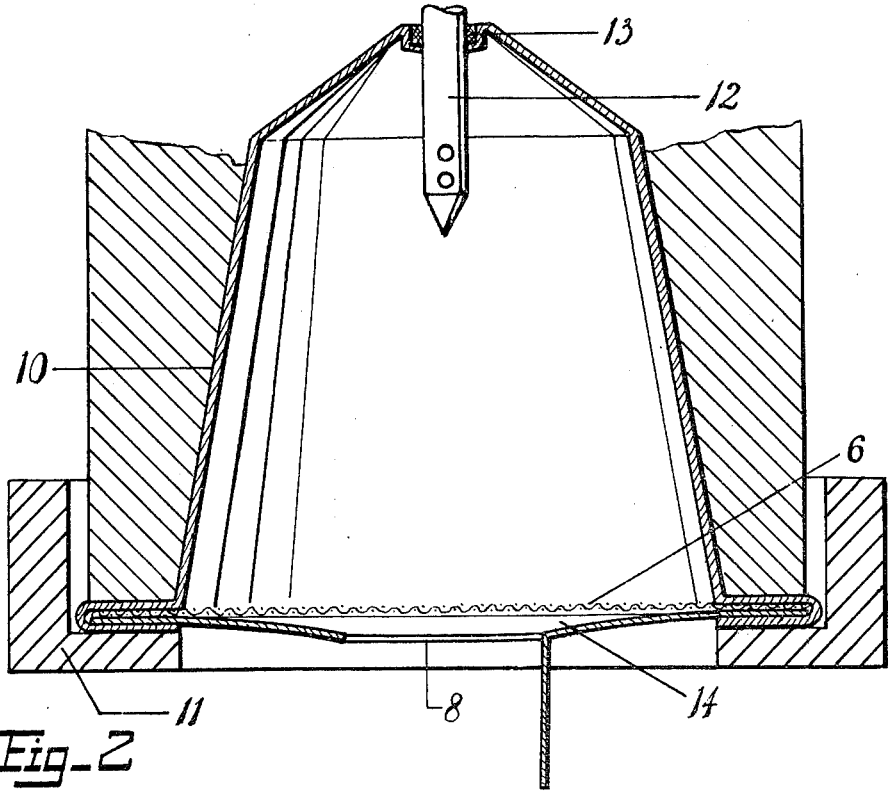
FIG. 2 shows the capsule in FIG. 1 in use.

When in use (FIG. 2), the capsule is placed in a housing 10 of an apparatus of conventional type for preparing drinks, such as so-called "expresso" coffee machines. The capsule is held in the housing 10 by a fixing member 11 secured to the apparatus by a bayonet fitting. Since the conical shape of the housing 10 corresponds to that of the body 1, the grip of the member 11 holds the capsule well and contributes to its resistance to internal pressure.

When the capsule is positioned in the housing 10, its vertex is perforated by an injecting member 12 of the apparatus while a packing ring 13 is placed in the recess 4 in the capsule. The liquid for making up the drink is then injected under pressure by the member 12 into the capsule and mixes with the substance 9. The pressure may be relatively high and may attain about 16 bar.

This pressure initially causes the membrane 5 to expand and finally to break along the line of weakness 7.

A determinate aperture 8 opens through which the drink flows uniformly. It will be observed that the convex shape of the membrane 5 forms beneath the filter 6 a collecting chamber 14 which distributes the flow evenly over the cross-section of the capsule and the filter 6.

When the attenuated line 7 is not closed, i.e. does not form a closed circle, the wall which closed the aperture 8 is not completely detached from the membrane 5 and does not risk falling into the cup, for example.

Finally the drink flows directly through the aperture 8 into the receiving vessel. The fixing member 11 may be merely annular with neither a collecting chamber nor an outlet nozzle necessitating frequent and laborious cleaning.

I claim:

1. A capsule containing a substance for making up a drink using an apparatus of the type which includes a water-injection piercing member which injects water into the capsule under pressure, said capsule being composed essentially of a sealed impervious body containing said substance and having the general shape of an upright acute truncated cone, the top of the body terminating into a generally domed end, said domed end having a recess for receiving said water-injection piercing member, the height of said body being approximately the same as the base dimension thereof, said body being provided at said base with an outer rim, a membrane defining a base closure member, and a filter interposed between said membrane, and said substance said membrane being resilient and bulging outwarding under the pressure of water injected into said capsule through said piercing member, said membrane being provided with an integral portion at least partially surrounded by a grooved line of weakness which brakes away from said membrane under the influence of the water pressure when said membrane is in bulged condition thereby forming an aperture in the membrane through which the drink will flow from the capsule.

2. A capsule according to claim 1, in which said membrane is provided with radial grooves for facilitating outward bulging of said membrane.

* * * * *